US006227948B1

(12) United States Patent
Khoury et al.

(10) Patent No.: US 6,227,948 B1
(45) Date of Patent: May 8, 2001

(54) POLISHING PAD RECONDITIONING VIA POLISHING PAD MATERIAL AS CONDITIONER

(75) Inventors: Raymond M. Khoury, Wappingers Falls, NY (US); Robert M. Merkling, Jr., Danbury, CT (US); Jose M. Ocasio, Maybrook; Uldis A. Ziemins, Poughkeepsie, both of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/532,170

(22) Filed: Mar. 21, 2000

(51) Int. Cl.[7] ..... B24B 1/00
(52) U.S. Cl. ..... 451/56; 451/443
(58) Field of Search ..... 451/56, 54, 41, 451/285, 287, 288, 290, 443, 444

(56) References Cited

U.S. PATENT DOCUMENTS 5,367,839 11/1994 Pearce .
5,655,951 8/1997 Meikle et al. .
5,738,574 * 4/1998 Tolles et al. ..... 451/287
5,779,526 * 7/1998 Gill ..... 451/444
5,785,585 * 7/1998 Manfredi et al. ..... 451/444
5,807,161 9/1998 Manor et al. .
6,004,196 * 12/1999 Doan et al. ..... 451/287
6,022,266 * 2/2000 Bullard et al. ..... 451/444

* cited by examiner

*Primary Examiner*—Derris H. Banks
(74) *Attorney, Agent, or Firm*—Wood, Phillips, VanSanten, Clark & Mortimer

(57) ABSTRACT

A method of reconditioning a polishing pad using a chemical-mechanical polishing apparatus is disclosed, wherein the polishing pad contacts a workpiece in the presence of a slurry to perform chemical-mechanical polishing on the workpiece. The method comprises contacting the polishing pad with a reconditioning pad. The reconditioning pad is made of a polishing pad material similar to that of the polishing pad.

13 Claims, 3 Drawing Sheets

POLISHING PAD RECONDITIONING VIA POLISHING PAD MATERIAL AS CONDITIONER

FIELD OF THE INVENTION

This invention relates to chemical-mechanical polishing of semiconductor wafers and, more particularly, to an apparatus and method for reconditioning a polishing pad using a chemical-mechanical polishing apparatus.

BACKGROUND OF THE INVENTION

Chemical-mechanical polishing (CMP) is performed in the processing of semiconductor wafers and/or chips on commercially available polishing apparatus. The standard CMP polishing apparatus has a circular polishing pad and a rotating carrier for holding the wafer. A slurry is used on the polishing pad.

Ideally, a CMP polishing apparatus delivers a globally uniform, as well as locally planarized, wafer. CMP polishing pads require reconditioning to maintain uniformity in polish rate. This is done to prevent oxide and slurry debris buildup on the polishing pad. If the film of debris is not removed, then polish rates and uniformity both degrade very quickly.

Conventional polishing pad apparatus use conditioning wheels that sweep across the polishing pad. The conditioning wheel typically holds a diamond grit conditioner. The diamond grit conditioners typically have grit values in the range of 40 to 200. The diamond grit conditioner can degrade polish pad life and cause contamination from the diamond grit and associated materials. The diamond grit conditioners are also expensive.

The present invention is directed to solving one or more of the problems discussed above in a novel and simple manner.

SUMMARY OF THE INVENTION

In accordance with the invention, there is provided a method of reconditioning a polishing pad using a polishing pad material.

Broadly, there is disclosed herein a method of reconditioning a polishing pad using a chemical-mechanical polishing apparatus, wherein the polishing pad contacts a workpiece in the presence of a slurry to perform chemical-mechanical polishing on the workpiece. The method comprises contacting the polishing pad with a reconditioning pad. The reconditioning pad is made of a polishing pad material similar to that ofthe polishing pad.

It is a feature of the invention that the polishing pad and reconditioning pad are of the same material.

In accordance with one aspect ofthe invention, the contacting step comprises rotating the polishing pad relative to the reconditioning pad.

In accordance with another aspect of the invention, the contacting step comprises sweeping the reconditioning pad across the polishing pad.

It is another feature of the invention to recondition the reconditioning pad. This is done using a second reconditioning pad of the same material.

It is a feature of the invention that the reconditioning pad is adhered to a conditioning wheel using an adhesive.

There is disclose in accordance with another embodiment of the invention an apparatus for reconditioning a polishing pad using a chemical-mechanical polishing apparatus. The apparatus includes a conditioning wheel. A reconditioning pad is affixed to the conditioning wheel. The reconditioning pad is made of a polishing pad material similar to that of the polishing pad. Means are provided for supporting the reconditioning pad in contact with the polishing pad and providing relative movement there between.

It is a feature of the invention that the reconditioning pad has an adhesive backing for adhering to the conditioning wheel.

Further features and advantages ofthe invention will be readily apparent from the specification and from the drawings.

DETAILED DESCRIPTION OF THE INVENTION

Figure 1:
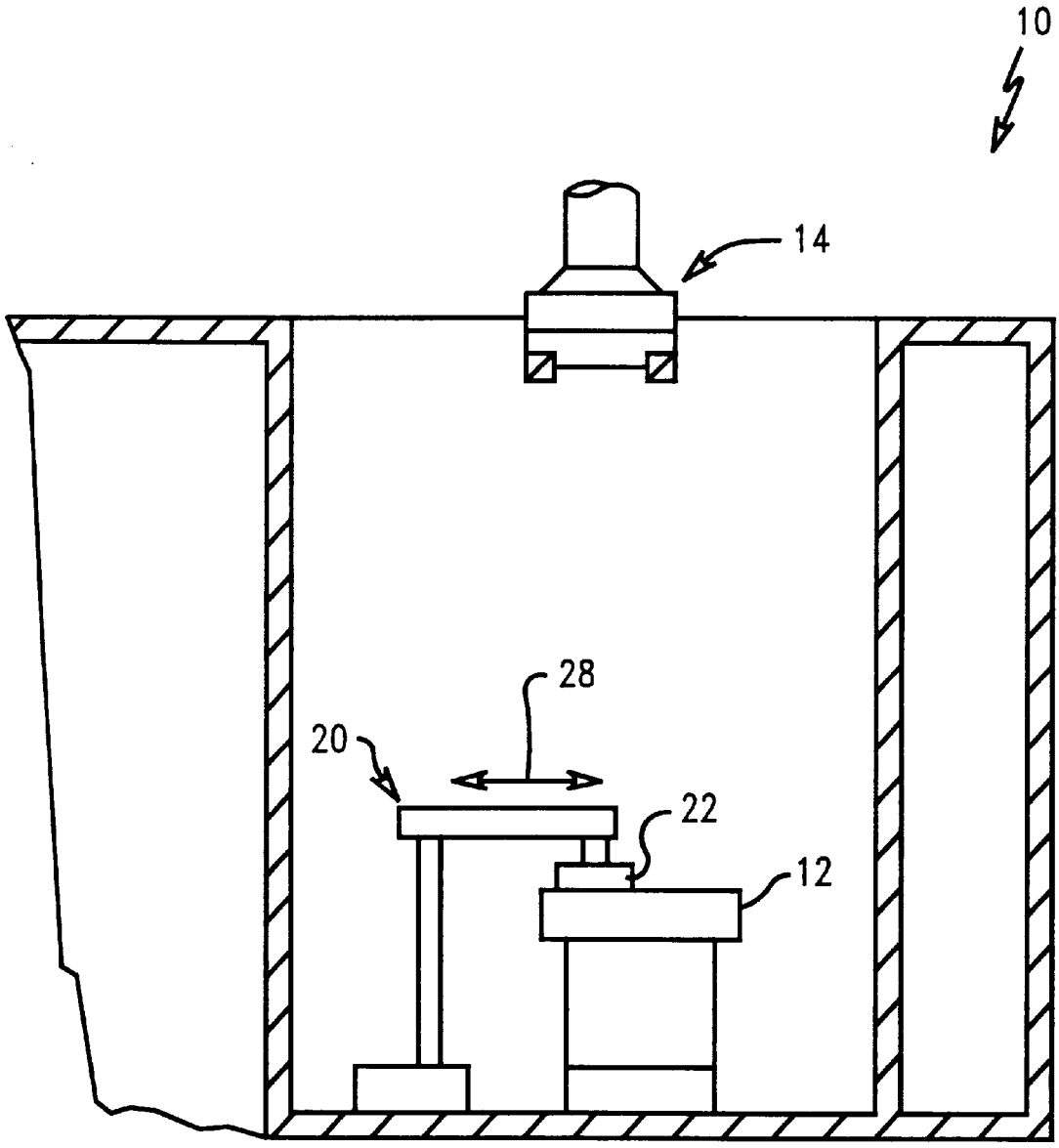
FIG. 1 is a side, partial sectional view of a chemical-mechanical polishing apparatus implementing a method for reconditioning a polishing pad in accordance with the invention.

Referring initially to FIG. 1, a chemical-mechanical polishing (CMW) apparatus 10 is illustrated. The CMP apparatus 10 is generally of conventional overall construction and includes a circular polishing table 12 and a rotating carrier 14. The carrier 14 is adapted to support a workpiece in the form a semiconductor wafer.

Figure 2:
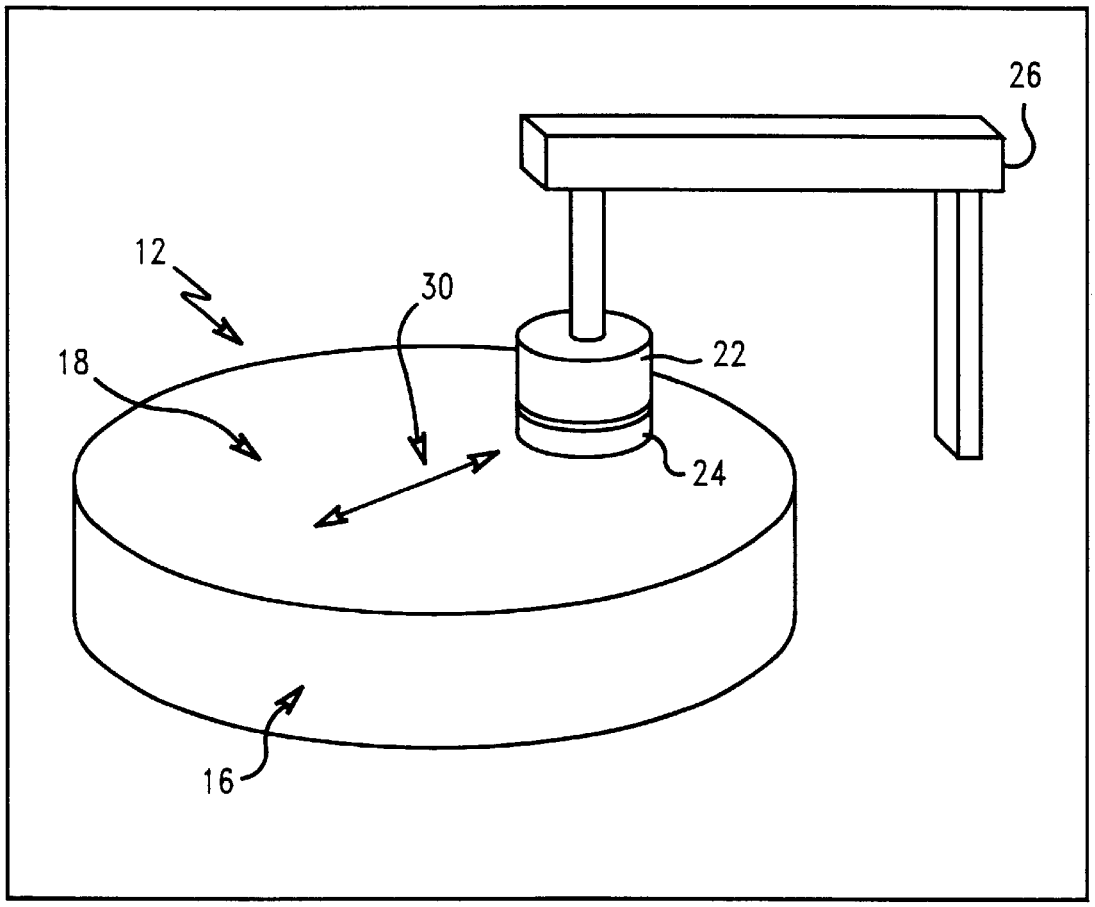
FIG. 2 is a partial perspective view illustrating the method of reconditioning a polishing pad in accordance with a first embodiment of the invention.

Referring also to FIG. 2, the polishing table 12 includes a platen 16 supporting a polishing pad 18 in a conventional manner. For chemical-mechanical polishing, a slurry (not shown) is applied to the polishing pad 18. The carrier 14, holding a semiconductor wafer, is positioned proximate the polishing table 12 so that the semiconductor wafer is in contact with the polishing pad 18 with the slurry therebetween. As is known, slurry and oxide from the semiconductor wafer can build up on the polishing pad 18. The present invention is directed to an apparatus and method for reconditioning the polishing pad 18 to extend useful life thereof In accordance with the invention, a polishing pad material is used in a reconditioning pad to recondition the surface of the polishing pad 18.

The CMP apparatus 10 includes a reconditioning apparatus 20. The reconditioning apparatus 20 includes a conditioning wheel 22, see also FIG. 3, supporting a reconditioning pad 24. The conditioning wheel 22 is supported on an arm 26 moveably mounted to the CMP apparatus 10. Particularly, the arm 26 is adapted to move in a linear direction, as indicated by an arrow 28 in FIG. 1, to sweep across the surface of the polishing pad 18, as indicated by an arrow 30 in FIG. 2. The particular structure for the arm 26 and its mounting for linear movement in the CMP apparatus 10 is conventional in nature and known in the art and does not itself form a part of the invention.

Figure 3:
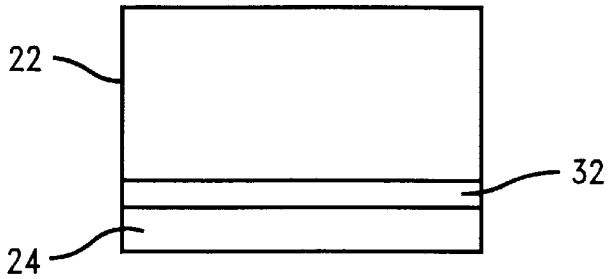
FIG. 3 is a side view of a conditioning wheel used with the apparatus of FIGS. 1 and 2.

Referring specifically to FIG. 3, the reconditioning pad 24 is made of a polishing pad material similar to that of the polishing pad 18. In one aspect of the invention the reconditioning pad 24 and polishing pad 18 are of the same material.

Reconditioning using the method described herein was tested on a Rodel IC 1000 polishing pad installed on the platen 16 and the conditioning wheel 22 equipped with a Rodel SUBA VI pad material to recondition the polish pad surface using the apparatus of FIGS. 1 and 2. The test results showed significant improvement in uniformity with minimal degradation of the polishing pad. The standard deviation of uniformity measurement of the semiconductor wafer improved by a factor of two and overall uniformity range was reduced by a factor of two.

To facilitate mounting of the reconditioning pad 24 to the conditioning wheel 22, the reconditioning pad 24 includes an adhesive backing layer 32. As such, the polishing pad material can be easily cut to shape and applied to the reconditioning wheel 22.

Figure 4:
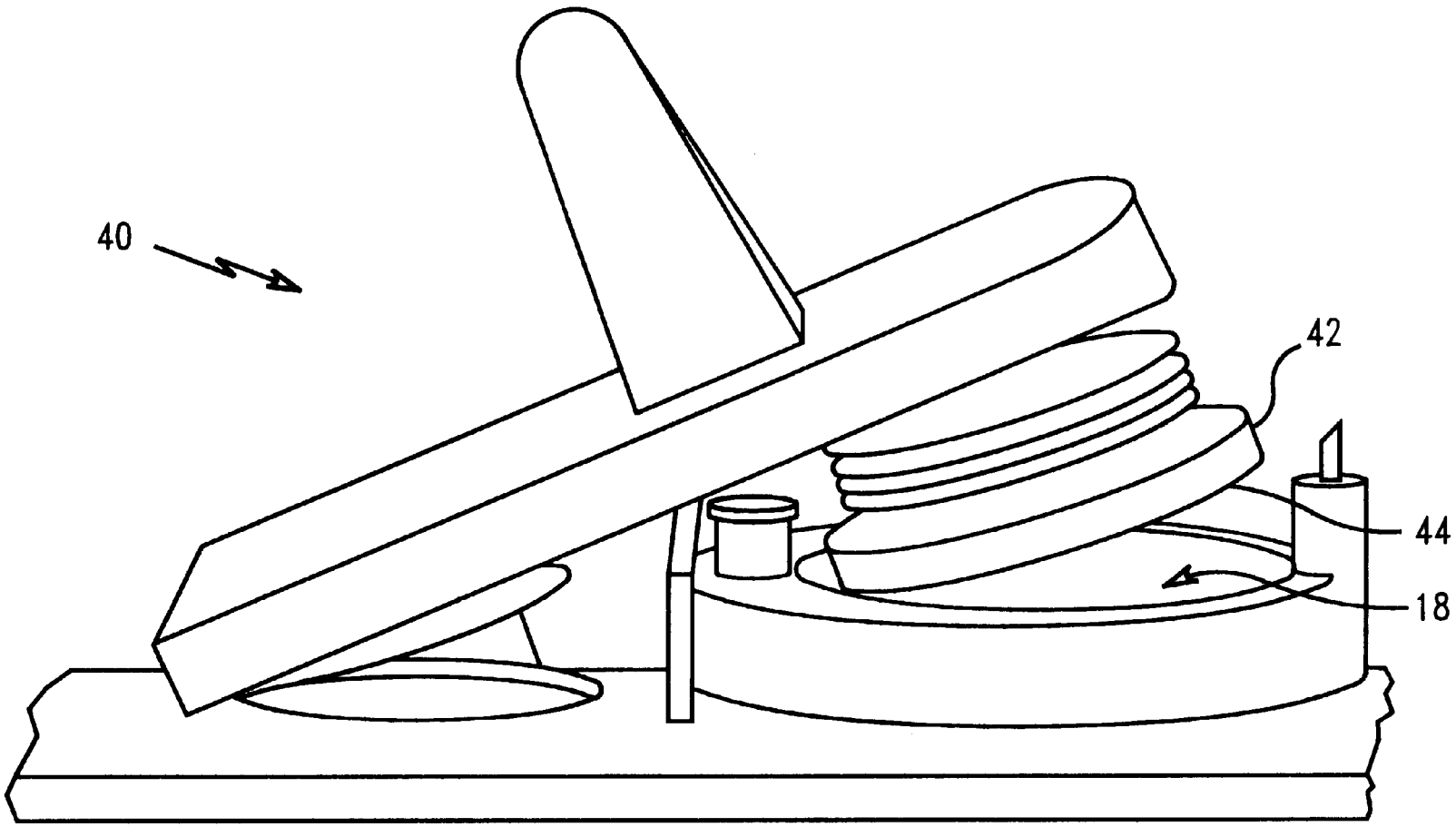
FIG. 4 is a perspective view of an apparatus for reconditioning a polishing pad in accordance with a second embodiment of the invention.

Referring to FIG. 4, a rotating pad conditioning apparatus 40 can also be used for reconditioning the polishing pad 18. The conditioning apparatus 40 is of conventional construction. A conditioning wheel 42 supports a reconditioning pad 44 in a conventional manner. The conditioning wheel 42 is adapted to position the reconditioning pad 44 in contact with the polishing pad 18. The conditioning wheel 42 is then rotated but does not sweep across the polishing pad 18.

The present application describes two apparatus for reconditioning a polishing pad using the CMP apparatus. These are two typical conditioner designs. There are numerous additional commercially available conditioner designs which could utilize the method according to the invention for reconditioning a polishing pad using a polishing pad material.

The polishing pad material comprising the reconditioning pad on the conditioning wheel will require occasional conditioning or cleaning itself This cleaning can be performed by knife edge, brushes, or diamond grit to help remove and keep the reconditioning pad free of slurry buildup. Likewise, a reconditioning apparatus, such as the apparatus 40 of FIG. 4, can be used to condition the reconditioning pad with a polishing pad material. The objective is to keep the reconditioning pad free of slurry and contaminants as with the polishing pad. In this case, the cleaner/conditioner material is not in direct contact with the polishing pad and the CMP apparatus. Instead, only a reconditioning pad using a polishing pad material is used in direct contact with the polishing pad on the platen 16.

In addition to the specific polish pads mentioned above, it is anticipated that the method of reconditioning described herein can be used with numerous polish pad materials. Additional examples, which are not intend to be limiting, include Rodel polishing pads IC 40, IC 60, HSP, MH C14B, as well as others.

Thus, the present invention is directed to the use of polishing pad to polishing pad conditioning to improve uniformity, contamination reduction, cost and ease of installation.

We claim:

1. A method for reconditioning a polishing pad used in a chemical-mechanical polishing apparatus, wherein the polishing pad contacts a work piece in the presence of a slurry to perform chemical-mechanical polishing on the work piece, the method comprising the step of:

contacting the polishing pad with a reconditioning pad, wherein the reconditioning pad is made of a polishing pad material similar to a material of the polishing pad.

2. The method of claim 1 wherein the reconditioning pad and polishing pad are of the same material.

3. The method of claim 1 wherein the contacting step comprises rotating the polishing pad relative to the reconditioning pad.

4. The method of claim 1 wherein the contacting step comprises sweeping the reconditioning pad across the polishing pad.

5. The method of claim 1 further comprising the step of reconditioning the reconditioning pad.

6. The method of claim 5 wherein the reconditioning pad is a first reconditioning pad and the first reconditioning pad is reconditioned using a second reconditioning pad of the same material as the first reconditioning pad.

7. The method of claim 1 further comprising the step of adhering the reconditioning pad to a conditioning wheel using an adhesive.

8. An apparatus for reconditioning a polishing pad used in a chemical-mechanical polishing apparatus, wherein the polishing pad contacts a work piece in the presence of a slurry to perform chemical-mechanical polishing on the work piece, comprising:

a reconditioning wheel;

a reconditioning pad affixed to the reconditioning wheel, wherein the reconditioning pad is made of a polishing pad material similar to a material of the polishing pad; and means for supporting the reconditioning pad in contact with the polishing pad and providing relative movement therebetween.

9. The apparatus of claim 8 wherein the reconditioning pad and polishing pad are of the same material.

10. The apparatus of claim 8 wherein the supporting means comprises means for rotating the polishing pad relative to the reconditioning pad.

11. The apparatus of claim 8 wherein the supporting means comprises means for sweeping the reconditioning pad across the polishing pad.

12. The apparatus of claim 8 wherein the reconditioning pad is adhered to a conditioning wheel using an adhesive.

13. The apparatus of claim 12 wherein the reconditioning pad has an adhesive backing for adhering to the reconditioning wheel.

* * * * *